US008051885B2

(12) United States Patent
Yang

(10) Patent No.: US 8,051,885 B2
(45) Date of Patent: Nov. 8, 2011

(54) OPERATION DEVICE FOR QUICK AND ACCURATE CONTROL OF WORKING DEVICE OF TENONER

(76) Inventor: Jack Yang, Fongyuan (TW)

( * ) Notice: Subject to any disclaimer, the term of this patent is extended or adjusted under 35 U.S.C. 154(b) by 119 days.

(21) Appl. No.: 12/510,321

(22) Filed: Jul. 28, 2009

(65) Prior Publication Data

US 2009/0288736 A1 Nov. 26, 2009

Related U.S. Application Data

(63) Continuation-in-part of application No. 11/590,763, filed on Nov. 1, 2006, now abandoned.

(51) Int. Cl.
*B27F 5/02* (2006.01)
*B27F 1/08* (2006.01)

(52) U.S. Cl. ..... 144/198.1; 144/71

(58) Field of Classification Search ..... 144/198.1, 144/144.51, 137, 69–71, 74–75, 82–87, 203–204.2
See application file for complete search history.

(56) References Cited

U.S. PATENT DOCUMENTS 2,080,859 A * 5/1937 Drapak et al. ..... 144/144.1
2,607,375 A * 8/1952 Gillespie et al. ..... 144/87
2,747,627 A * 5/1956 Havlik ..... 144/85
2,912,879 A * 11/1959 Bannow ..... 74/525
3,272,244 A * 9/1966 Nemec ..... 144/87
4,787,127 A 11/1988 Beall ..... 29/26 A
5,305,812 A 4/1994 Ferencsik ..... 144/356
5,492,160 A * 2/1996 McCracken ..... 144/367
5,494,089 A * 2/1996 Lubbe ..... 144/144.1
5,655,583 A * 8/1997 Heintzeman ..... 144/204.2
5,657,804 A * 8/1997 Lee ..... 144/136.95
5,967,715 A 10/1999 Porper ..... 409/109
6,305,447 B1 10/2001 Rousseau ..... 144/371
6,929,042 B2 8/2005 Chang ..... 144/71
6,991,007 B2 * 1/2006 Chang ..... 144/71
7,882,867 B2 * 2/2011 Yang ..... 144/144.51
2008/0257452 A1 * 10/2008 Yang ..... 144/205

* cited by examiner

*Primary Examiner* — David J. Walczak
*Assistant Examiner* — Jennifer C Chiang
(74) *Attorney, Agent, or Firm* — Alan Kamrath; Kamrath & Associates PA

(57) ABSTRACT

An operation device includes a connecting member mounted on and moved with a working device of a tenoner. A positioning mechanism is mounted on and moved with the connecting member and includes a tube mounted on the connecting member and adapted to be fixed at various positions, an elastic member and a shaft retained in a hollow of the tube. The shaft includes an end extended outside of the tube and a roller mounted on the end and engaged with a guiding member. The elastic member is disposed between the tube and the shaft and selectively depressed such that the elastic member enables the shaft to movably engage with an undulated edge of the guiding member in a quick and accurate manner.

14 Claims, 9 Drawing Sheets

OPERATION DEVICE FOR QUICK AND ACCURATE CONTROL OF WORKING DEVICE OF TENONER

CROSS REFERENCE

The present application is a continuation-in-part application of U.S. patent application Ser. No. 11/590,763, filed on Nov. 1, 2006, now abandoned, of which the entire disclosure is incorporated herein.

BACKGROUND OF THE INVENTION

1. Field of the Invention

The present invention relates to an operation device and, in particular, to a device that facilitates a user to quickly and accurately displace a working device of a tenoner to manufacture a tenon and/or mortise during the working process.

2. Description of the Related Art

U.S. Pat. No. 6,929,042 entitled "SEMI-AUTOMATIC MORTISING MACHINE"shows a mortising machine including a support bar, a working device utilized to manufacture a tenon and/or a mortise in a workpiece, and a guide device movably mounted thereon for directing the working device to cut the workpiece. The support bar includes a plurality of protuberances collectively defining an undulated edge. The guide device includes a molding bar mounted thereon. The guide device can move the molding bar along the undulated edge of the support bar. Thus, the working device can cut tenons and/or mortises in the workpiece according to the profile of the undulated edge. Further, the molding bar includes a second end formed with a locking groove, and a thread rod has a bolt head selectively locked in the locking groove. When the bolt head is disengaged from the locking groove, the molding bar can be adjusted with respect to the support bar in order to vary a distance therebetween. A problem is that it is difficult to move the molding bar along the undulated edge quickly and accurately and to vary the distance between the molding bar and the support bar.

The present invention is, therefore, intended to obviate or at least alleviate the problems encountered in the prior art.

SUMMARY OF THE INVENTION

According to the present invention, an operation device includes a connecting member mounted on and moved with a working device of a tenoner. The working device can cut tenons and/or mortises in a workpiece clamped on the tenoner. The operation device further includes a positioning mechanism mounted on and moved with the connecting member. The positioning mechanism includes a tube mounted on the connecting member and adapted to be fixed at various positions, an elastic member and a shaft retained in a hollow of the tube. The shaft includes an end extended outside of the tube and a roller mounted on the end and engaged with a guiding member of the tenoner. The elastic member is disposed between the tube and the shaft and is selectively depressed.

It is an object of the present invention that the elastic member enables the shaft to movably engage with an undulated edge of the guiding member in a quick and accurate manner.

It is another object of the present invention that the guiding member includes the plurality of sides, that each of the sides includes the plurality of protuberances defining the undulated edge, that each undulated edge defines an undulation pitch distance, and that the working device can cut two tenons and/or mortises with a distance therebetween according to the predetermined undulation pitch distance.

Other objects, advantages, and new features of the present invention will become apparent from the following detailed description of the invention when considered in conjunction with the accompanied drawings.

DETAILED DESCRIPTION OF THE PREFERRED EMBODIMENT

Figure 1:
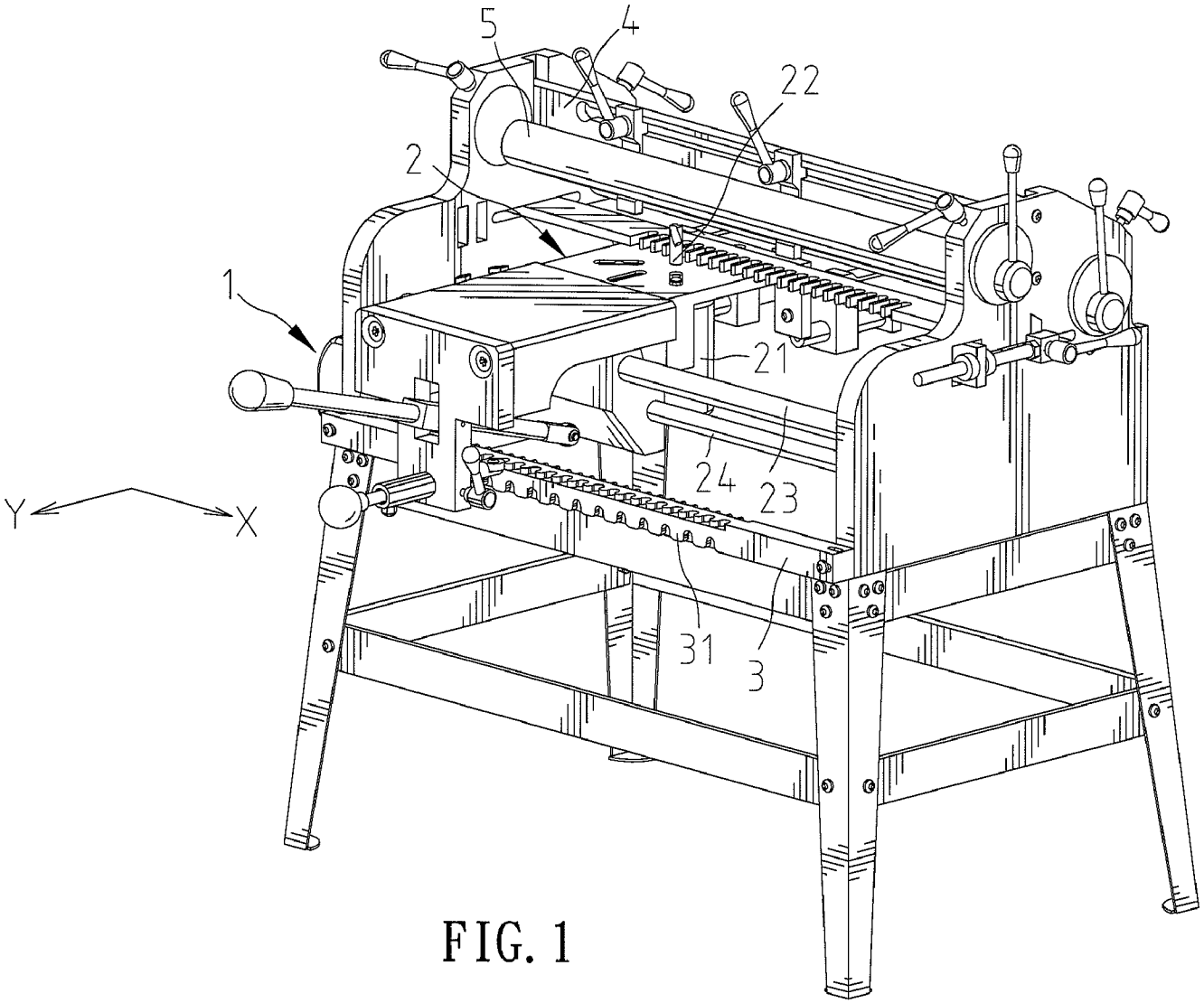
FIG. 1 is a perspective view of a tenoner in accordance with the present invention.

FIG. 1 shows a tenoner in accordance with the present invention. The tenoner includes an operation device 1, and a working device 2 connected and incorporated with the operation device 1. The working device 2 is movable in "X" direction and "Y" directions. In the preferred embodiment, the working device 2 is moved on rails 23 and 24 extending in "X" and "Y" directions. The rail on the "Y" direction is not in view. Further, the working device 2 includes a motor 21 and a cutting bit 22 driven by the motor 21 for cutting tenons and/or mortises in a workpiece. The workpiece is clamped on a platform 4 during the working process. Further, the workpiece is securely held on the platform 4 by a cam structure 5. The tenoner also includes a guiding member 3 disposed axially in the direction of "X". The guiding member 3 includes a plurality of sides, and each of the plurality of sides includes a plurality of protuberances 31 collectively defining an undulated edge. The undulated edge preferably includes a plurality of arcuate and substantially curved sections. Additionally, one side of the guiding member 3 defines a first undulation pitch distance, another side defines a second undulation pitch distance, and further side defines a third undulation pitch distance and so on. The first, second, and third pitch distances are all different. Further, the operation device 1 includes a positioning mechanism 11 engaged with the guiding member 3. Further, the operation device 1 is used to move the working device 2, and the positioning mechanism 11 is moved along the undulated edge of one of the sides of the guiding member 3. The working device 2 can cut two tenons and/or mortises whose with a distance therebetween according to the predetermined undulation pitch distance.

Figure 2:
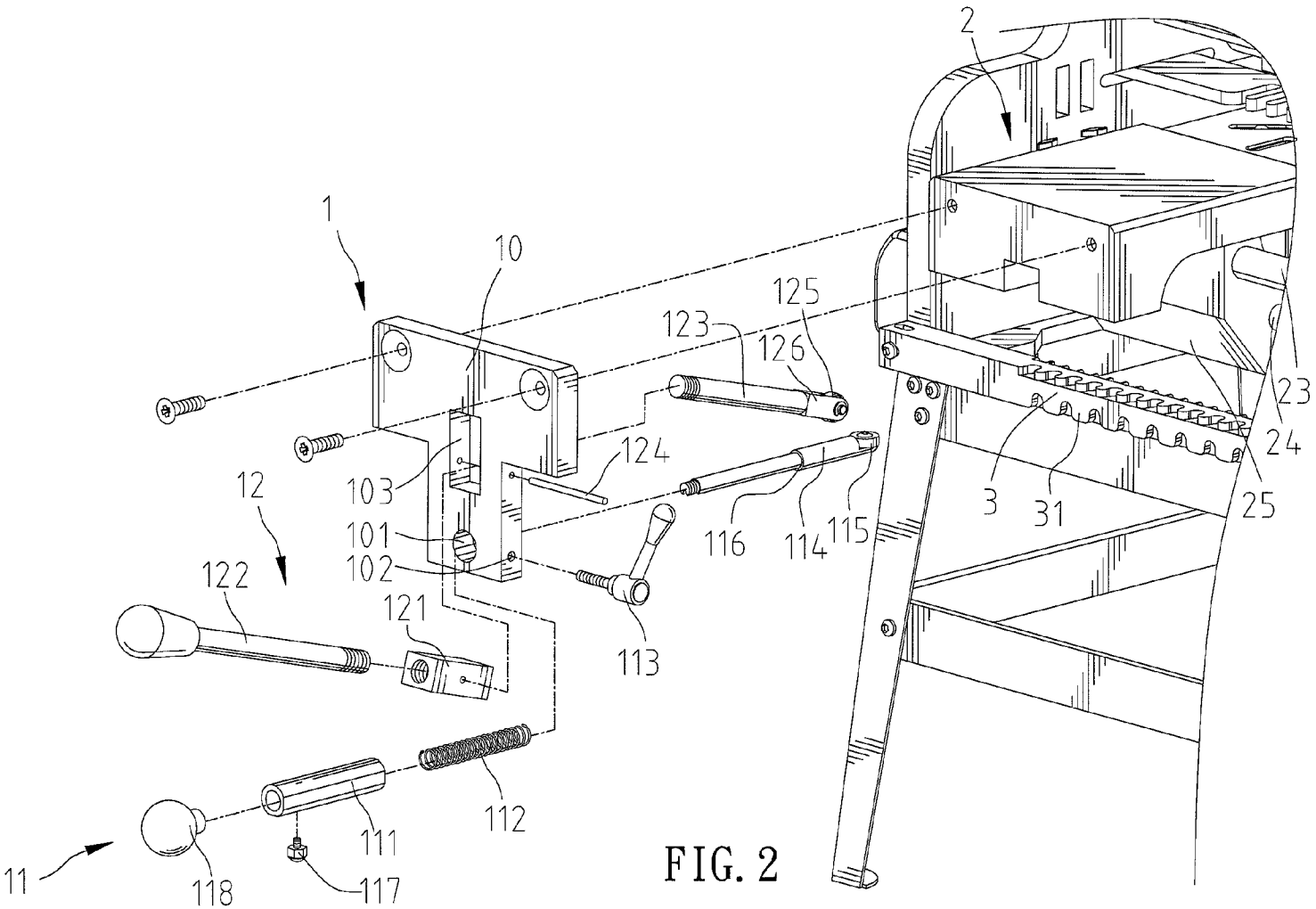
FIG. 2 is an exploded, perspective view of an operation device shown in FIG. 1, with the operation device incorporated with a working device for controlling the working device.
Figure 3:
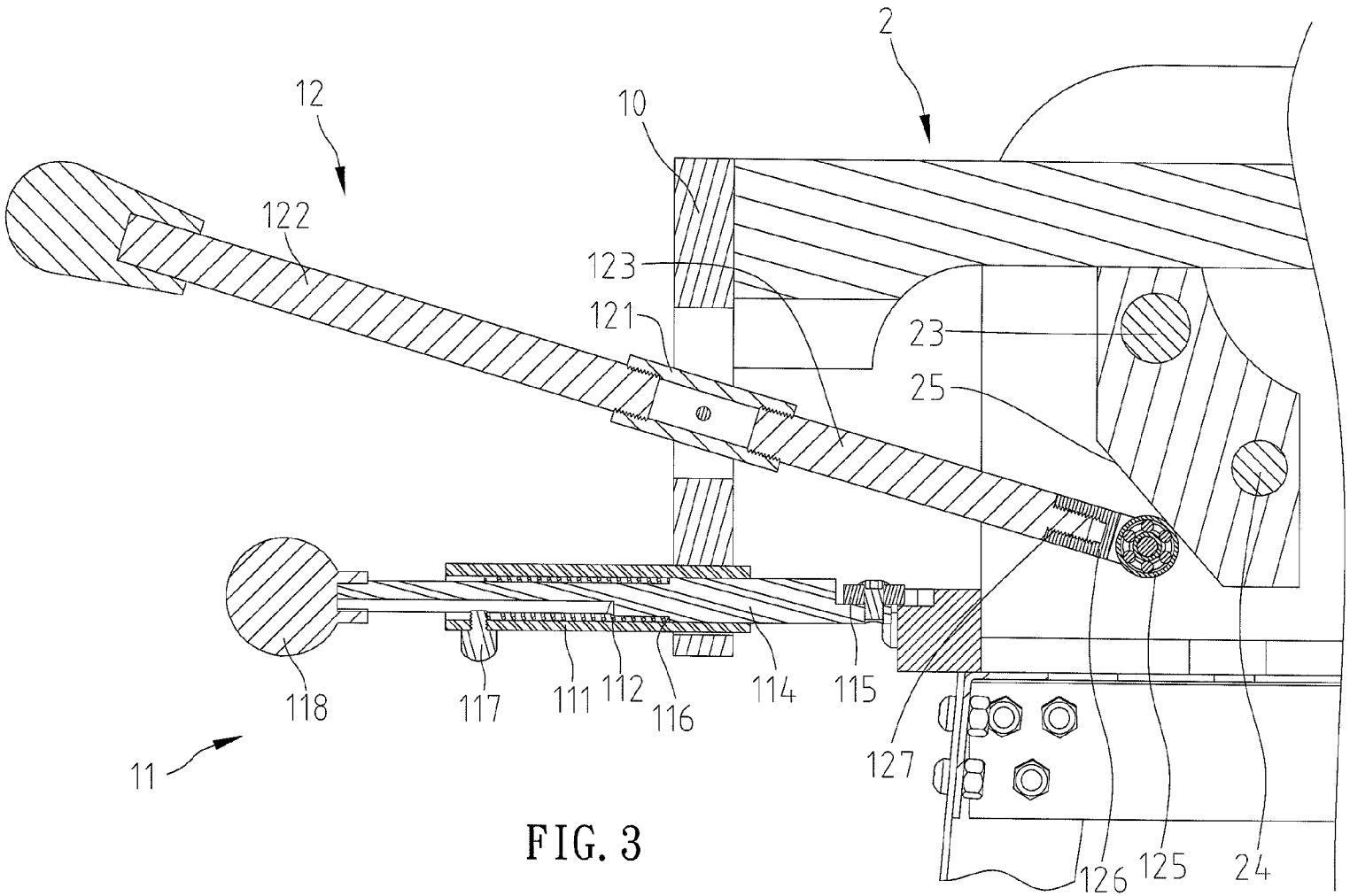
FIG. 3 is a cross-sectional view of the operation device.

Referring to FIGS. 2 and 3, the positioning mechanism 11 is mounted on a connecting member 10 of the operation device 1 which is mounted on the working device 2. The positioning mechanism 11 includes a tube 111 mounted on the connecting member 10. The connecting member 10 includes a first hole 101 extended therethrough, and the tube 111 is inserted through the first hole 101. The tube 111 is movable with respect to the connecting member 10. Further, the connecting member 10 includes a second hole 102 defined therein and connected with the first hole 101. The second hole 102 includes a fastening member 113 inserted therethrough and selectively engaged with an outer peripheral of the tube 111 in order to hold the tube 111 in a fixed position. The tube 111 also includes an elastic member 112 and a shaft 114 received in a hollow defined therein. The shaft 114 includes a first end extended outside a first end of the tube 111 and a second end extended outside a second end of the tube 111 and engaged with the undulated edge of the guiding member 3. Preferably, the second end of the shaft 114 is arcuate and substantially curved. Further, the elastic member 112 is disposed between the tube 111 and the shaft 114 and includes a first end retained by a shoulder 116 of the shaft 114. The shoulder 116 is formed between the first and second ends of the shaft 114 and extends between a smaller diametrical section and a larger diametrical section of the shaft 114. A second end of the elastic member 112 is retained by a stopper 117 which is mounted between the first end of the tube 111 and the shoulder 116 and which includes a section disposed inside the tube 111 so as to retain the second end of the elastic member 112.

Thus, the shaft 114 is biased by the elastic member 112, and the elastic member 112 prevents the shaft 114 to disengage from the shape of the undulated edge of the guiding member 3.

Since the undulated edge of the guiding member 3 is preferably configured of a plurality of arcuate and substantially curved sections and the second end of the shaft 114 is arcuate and substantially curved, the shaft 114 can be movably engaged with the shape of the guiding member 3 easily. In addition, the second end of the shaft 114 may include a roller 115 mounted and engaged with the undulated edge of the guiding member 3 so as to facilitate the user to move the shaft 114 along the guiding member 3.

Furthermore, the first end of the shaft 114 may include a grip 118 in order to facilitate the user to hold during movement of the shaft 114.

The operation device 1 also includes a control mechanism 12 mounted on the connecting member 10. The control mechanism 12 is used to control displacement of the working device 2 and includes a joint 121 pivotally mounted on the connecting member 10 by a pivot axle 124. The connecting member 10 includes a third hole 103 extended therethrough, and the joint 121 is pivotally mounted in the third hole 103 by the pivot axle 124. Further, the first hole 101 extends through the connecting member 10 in a first direction, whereas the third hole 103 extends through the connecting member in a second direction. The first and second directions are parallel to each other. The control mechanism 12 also includes a control member 122 mounted on a first end of the joint 121 and disposed on one side of the connecting member 10. The control member 122 is adapted to be gripped by the user to control pivotal movement of the joint 121. The control mechanism 12 further includes an engaging member 123 mounted on a second end of the joint 121 and disposed on the other side of the connecting member 10. The engaging member 123 includes a wheel 125 engaged with a slope 25 formed on the working device 2. Further, the wheel 125 is mounted on a seat 126, and the seat 126 is mounted on an end 127 of the engaging member 123. Preferably, the seat 126 and the engaging member 123 are threadly engaged.

Figure 4:
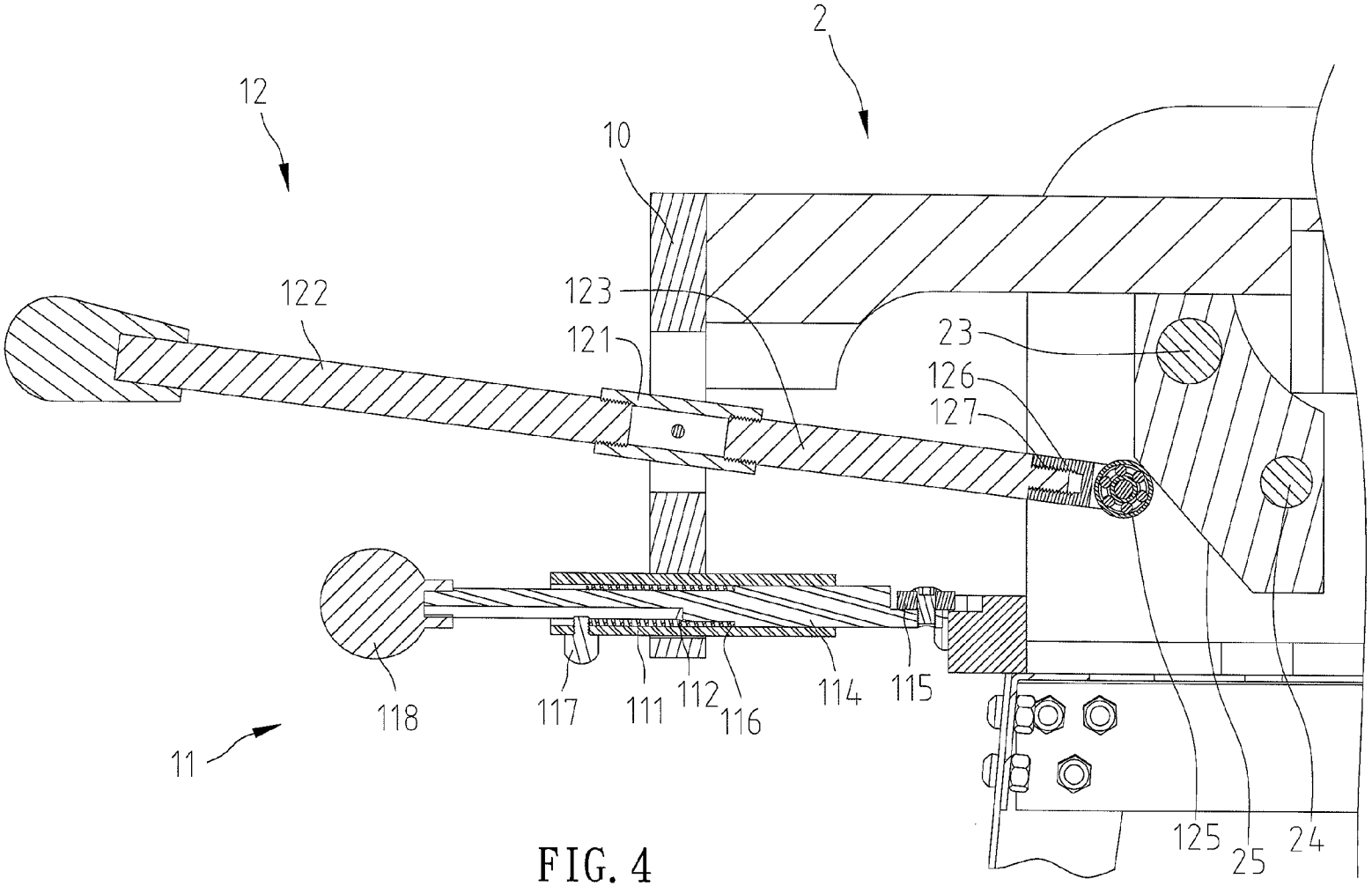
FIG. 4 is a cross-sectional view similar to FIG. 3, but showing the operation device and the working device in other positions.
Figure 8:
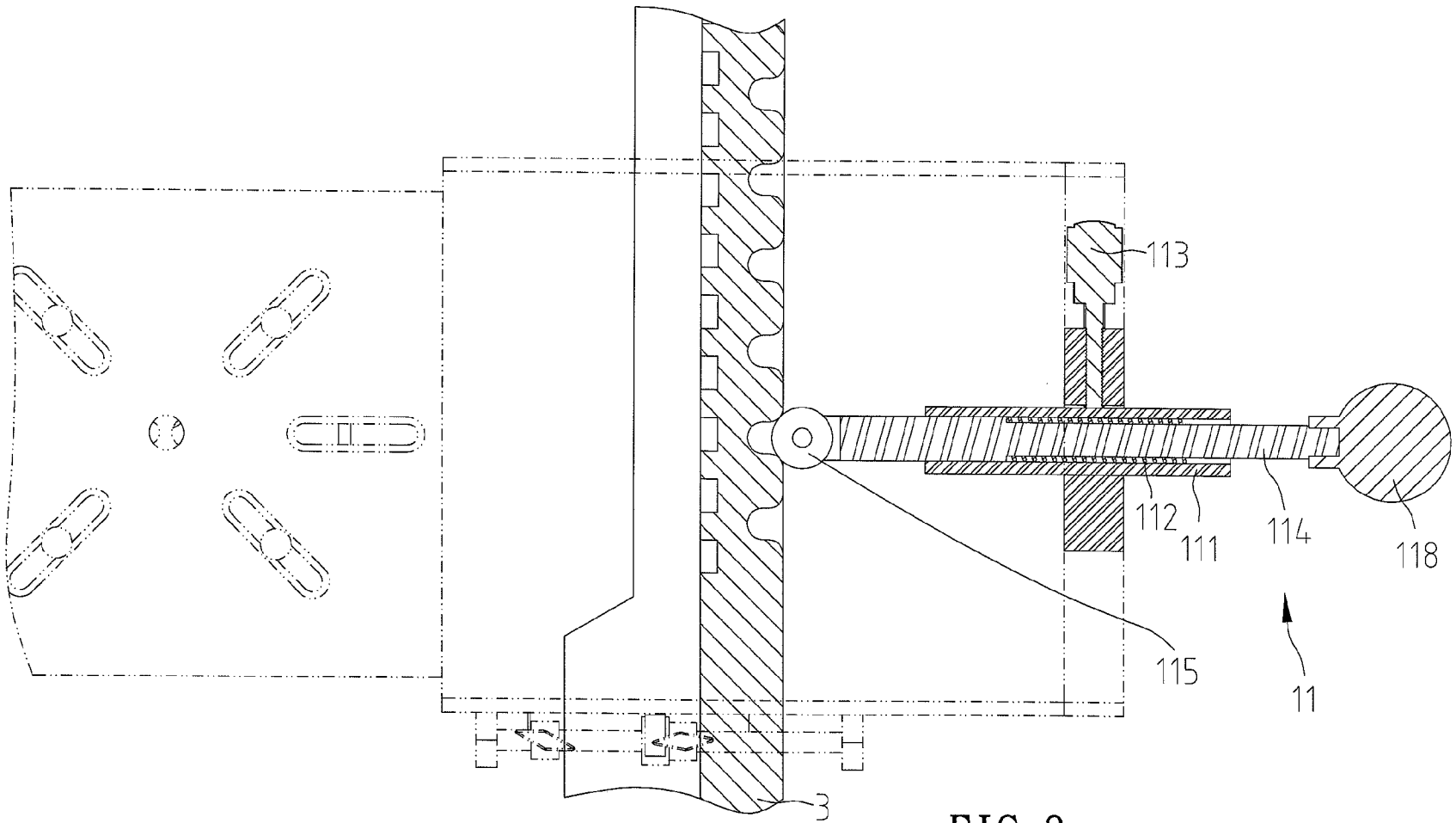
FIGS. 8-9 are cross-sectional views showing the operation device changed from a first position to a second position when the working device is shifted from the position shown in FIG. 3 to the position shown in FIG. 4.
Figure 9:
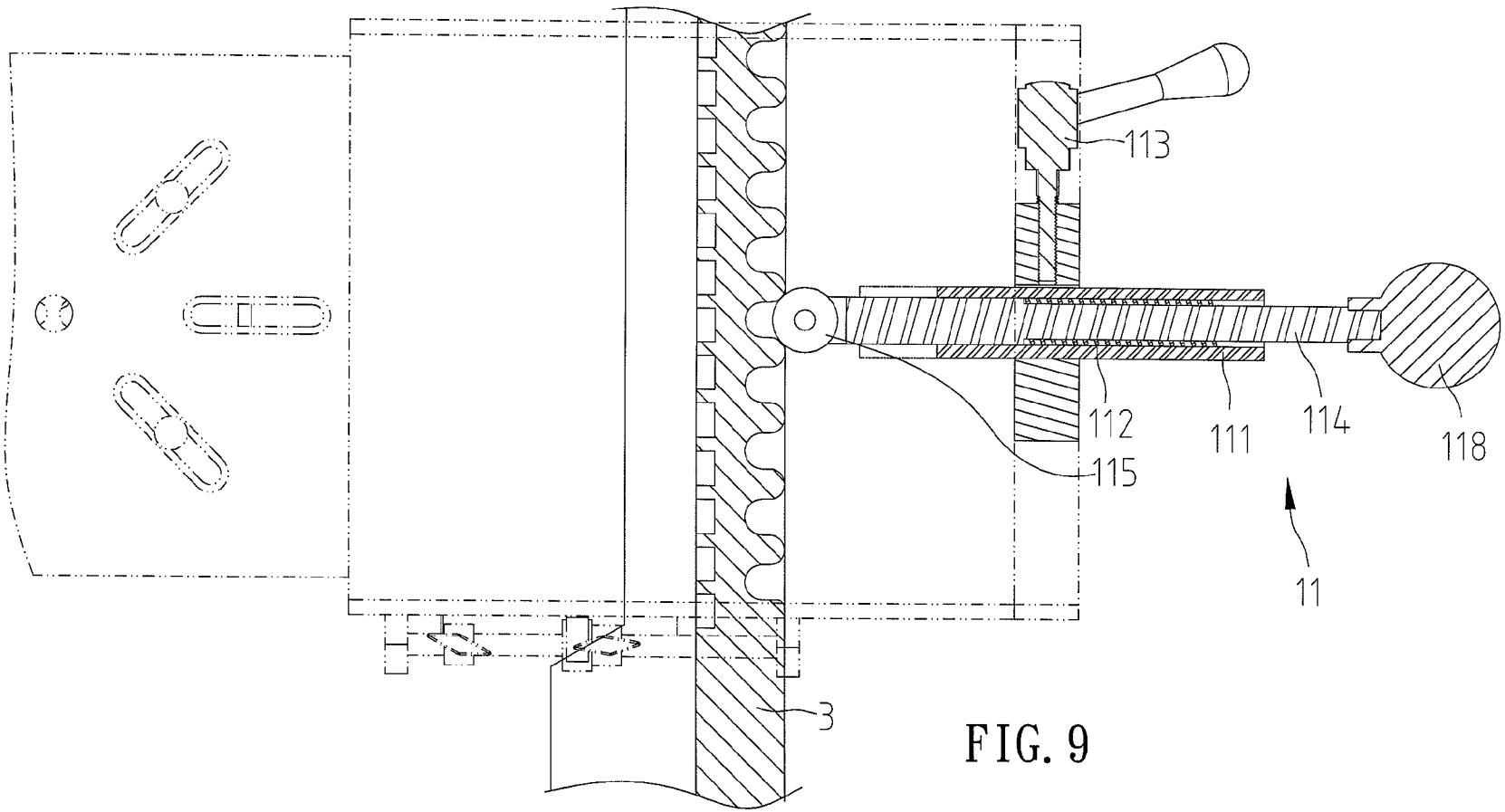

Referring to FIGS. 3 and 4 in conjunction with FIGS. 8 and 9, the control mechanism 12 is pivoted, and the working device 2 is shifted from a first position to a second position, i.e. in the "Y" direction. Also, the wheel 125 mounted on the engaging member 123 is rotatably moved and engaged on the slope 25 upon pivoting of the control mechanism 12. Further, the tube 111 of the positioning mechanism 11 is relocated on the connecting member 10.

Figure 5:
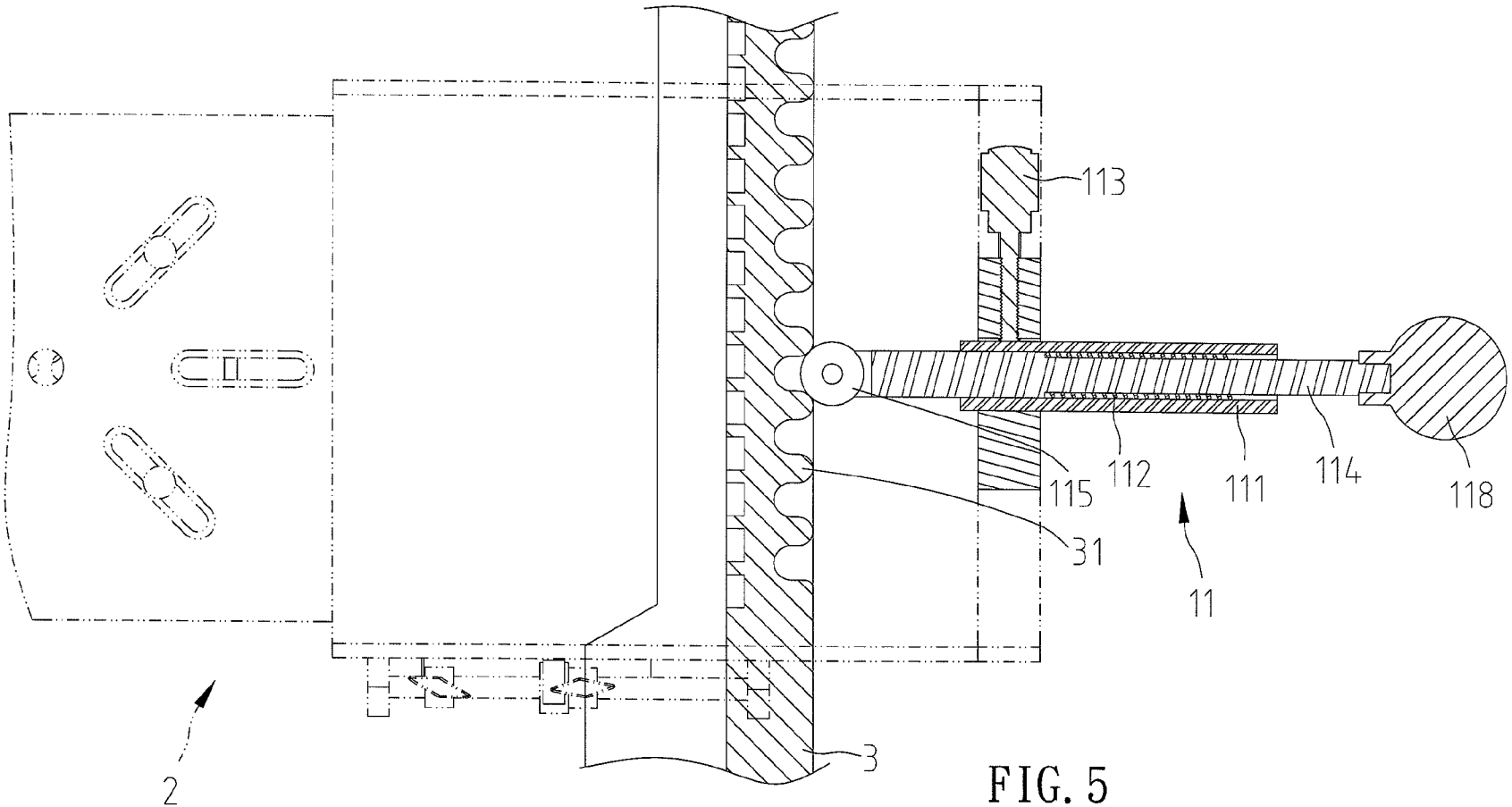
FIGS. 5-7 are cross-sectional views showing the operation of the operation device, with the operation device guided by a guiding member, and with the working piece shifted in parallel to an axis of the guiding member.
Figure 6:
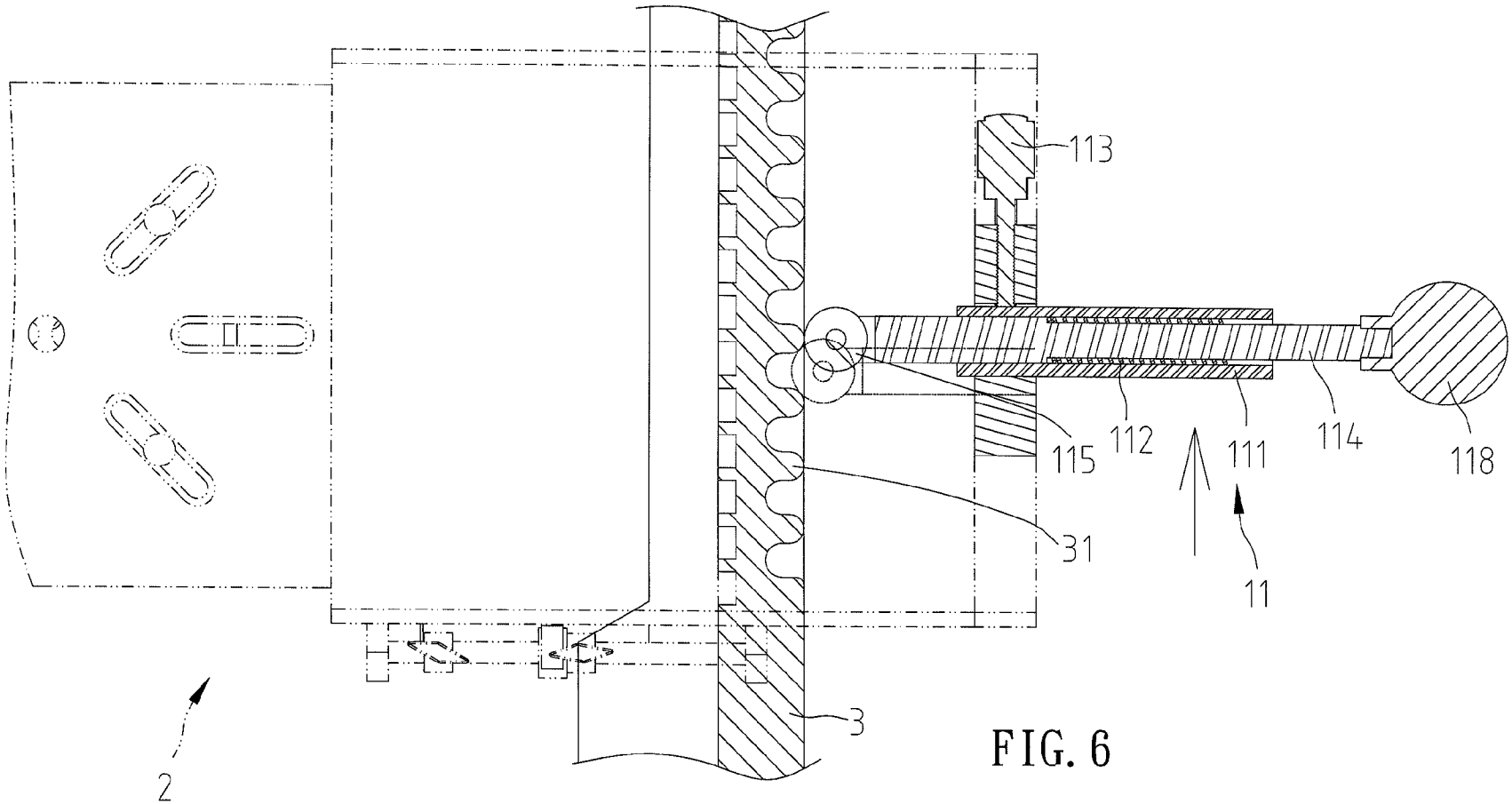
Figure 7:
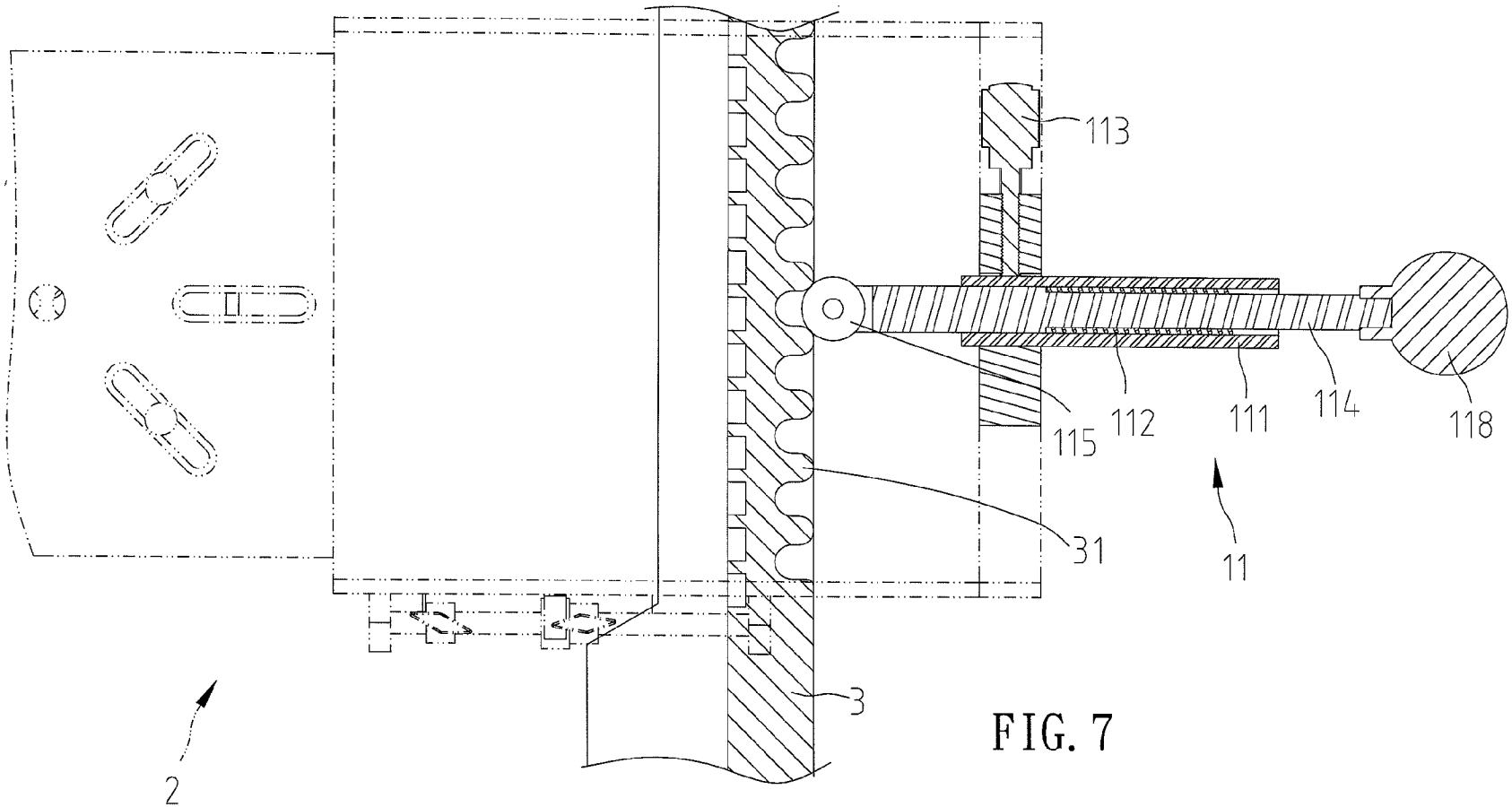

Referring to FIGS. 5 through 7, the positioning mechanism 11 is movably engaged with the undulated edge of the guiding member 3, the elastic member 112 is selectively depressed, and the working device 2 is shifted from a first position to a second position, i.e. in the "X" direction.

In view of forgoing, the operation device 1 enables the working device 2 to displace from one position to another position quickly and accurately.

Further, the positioning mechanism 11 is movably engaged with the undulated edge of the guiding member 3, and the shaft 114 is biased by the elastic member 112 so that the shaft 114 can be quickly moved on the guiding member 3.

Further, the guiding member 3 includes the plurality of sides, and each of the sides includes the plurality of protuberances 31 defining the undulated edge. Each undulated edge defines an undulation pitch distance, and the working device 2 can cut two tenons and/or mortises with a distance therebetween according to the predetermined undulation pitch distance.

While the specific embodiments have been illustrated and described, numerous modifications come to mind without significantly departing from the spirit of invention, and the scope of invention is only limited by the scope of the accompanying claims.

What is claimed is:

1. An operation device for controlling a working device adapted to manufacture a tenon and/or a mortise in a workpiece, with the working device movably mounted on a tenoner, with the tenoner including a guiding member mounted thereon and including a plurality of sides each formed with a plurality of protuberances, with the plurality of protuberances disposed in a longitudinal direction of the guiding member, and with the plurality of protuberances collectively defining an undulated edge, comprising:

a connecting member mounted on and moved with the working device; and a positioning mechanism mounted on and moved with the connecting member, with the positioning mechanism including a tube mounted on the connecting member and adapted to be fixed at various positions with respect to the connecting member, an elastic member and a shaft retained in a hollow of the tube, with the shaft including an end extended outside of the tube and engaged with the undulated edge of the guiding member, with the elastic member disposed between the tube and the shaft and selectively depressed such that the elastic member enables the shaft to movably engage with a shape of the undulated edge of the guiding member in a quick and accurate manner, wherein the elastic member includes a first end retained by a shoulder of the shaft which extends between a smaller diametrical section and a larger diametrical section of the shaft, and a second end retained by a stopper which is mounted between the first end of the tube and the shoulder and which includes a section disposed inside the tube to retain the second end of the elastic member.

2. The operation device as claimed in claim 1 wherein the shaft includes a roller mounted on an end thereof and engaged with the undulated edge of the guiding member, with the roller facilitating movement of the shaft along the undulated edge of the guiding member.

3. The operation device as claimed in claim 1 wherein the shaft includes another end extended outside of the tube and a grip mounted on the other end in order to facilitate operably moving the shaft.

4. The operation device as claimed in claim 1 wherein the operation device includes a control mechanism adapted for controlling displacement of the working device, with the control mechanism pivotally mounted on the connecting member, with the control mechanism including a wheel movably engaged with a slope defined on the working device upon pivoting of the control mechanism, with the working device shifted from a first position to a second position, and with the positioning mechanism relocated in order to enable the shaft to engage with the guiding member.

5. The operation device as claimed in claim 1 wherein the shaft includes a roller mounted on an end thereof and engaged with the undulated edge of the guiding member, with the roller facilitating movement of the shaft along the undulated edge of the guiding member.

6. The operation device as claimed in claim 4 wherein the control mechanism includes a joint pivotally mounted on the connecting member by a pivot axle, a control member mounted on a first end of the joint and disposed on one side of the connecting member, and an engaging member mounted on a second end of the joint and disposed on the other side of the connecting member, with the wheel connected with the engaging member.

7. The operation device as claimed in claim 6 wherein the connecting member includes a third hole extended therethrough, with the joint pivotally mounted in the third hole by the pivot axle.

8. An operation device for controlling a working device adapted to manufacture a tenon and/or a mortise in in a workpiece, with the working device movably mounted on a tenoner, with the tenoner including a guiding member mounted thereon and including a plurality of sides each formed with a plurality of protuberances, with the plurality of protuberances disposed in a longitudinal direction of the guiding member, and with the plurality of protuberances collectively defining an undulated edge, comprising:

a connecting member mounted on and moved with the working device; and a positioning mechanism mounted on and moved with the connecting member, with the positioning mechanism including a tube mounted on the connecting member and adapted to be fixed at various positions with respect to the connecting member, an elastic member and a shaft retained in a hollow of the tube, with the shaft including an end extended outside of the tube and engaged with the undulated edge of the guiding member, with the elastic member disposed between the tube and the shaft and selectively depressed such that the elastic member enables the shaft to movably engage with a shape of the undulated edge of the guiding member in a quick and accurate manner, and the shaft is movably engaged with one undulated edge with a first undulation pitch distance defined between the two protuberances, and wherein the shaft is movably engaged with another undulated edge with a second undulation pitch distance, and with the second undulation pitch distance being different to the first undulation pitch distance, wherein the elastic member includes a first end retained by a shoulder of the shaft which extends between a smaller diametrical section and a larger diametrical section of the shaft, and a second end retained by a stopper which is mounted between the first end of the tube and the shoulder and which includes a section disposed inside the tube to retain the second end of the elastic member.

9. The operation device as claimed in claim 8 wherein the shaft includes another end extended outside of the tube and a grip mounted on the other end in order to facilitate user to operably move the shaft.

10. The operation device as claimed in claim 8 wherein the operation device includes a control mechanism adapted for controlling displacement of the working device, with the control mechanism pivotally mounted on the connecting member, with the control mechanism including a wheel movably engaged with a slope defined on the working device upon pivoting of the control mechanism, with the working device shifted from a first position to a second position, and with the positioning mechanism relocated in order to enable the shaft to engage with the guiding member.

11. The operation device as claimed in claim 10 wherein the control mechanism includes a joint pivotally mounted on the connecting member by a pivot axle, a control member mounted on a first end of the joint and disposed on one side of the connecting member, and an engaging member mounted on a second end of the joint and disposed on the other side of the connecting member, with the wheel connected with the engaging member.

12. The operation device as claimed in claim 11 wherein the connecting member includes a third hole extended therethrough, with the joint pivotally mounted in the third hole by the pivot axle.

13. An operation device for controlling a working device adapted to manufacture a tenon and/or a mortise in a workpiece, with the working device movably mounted on a tenoner, with the tenoner including a guiding member mounted thereon and including a plurality of sides each formed with a plurality of protuberances, with the plurality of protuberances disposed in a longitudinal direction of the guiding member, and with the plurality of protuberances collectively defining an undulated edge, comprising:

a connecting member mounted on and moved with the working device; and a positioning mechanism mounted on and moved with the connecting member, with the positioning mechanism including a tube mounted on the connecting member and adapted to be fixed at various positions with respect to the connecting member, an elastic member and a shaft retained in a hollow of the tube, with the shaft including an end extended outside of the tube and engaged with the undulated edge of the guiding member, with the elastic member disposed between the tube and the shaft and selectively depressed such that the elastic member enables the shaft to movably engage with a shape of the undulated edge of the guiding member in a quick and accurate manner, wherein the connecting member includes a first hole extended therethrough, with the tube inserted through the first hole, and wherein the connecting member includes a second hole defined therein and connected with the first hole, with the second hole including a fastening member inserted therethrough and selectively engaged with an outer peripheral of the tube in order to hold the tube in a fixed position.

14. An operation device for controlling a working device adapted to manufacture a tenon and/or a mortise in a workpiece, with the working device movably mounted on a tenoner, with the tenoner including a guiding member mounted thereon and including a plurality of sides each formed with a plurality of protuberances, with the plurality of protuberances disposed in a longitudinal direction of the guiding member, and with the plurality of protuberances collectively defining an undulated edge, comprising:

a connecting member mounted on and moved with the working device; and a positioning mechanism mounted on and moved with the connecting member, with the positioning mechanism including a tube mounted on the connecting member and adapted to be fixed at various positions with respect to the connecting member, an elastic member and a shaft retained in a hollow of the tube, with the shaft including an end extended outside of the tube and engaged with the undulated edge of the guiding member, with the elastic member disposed between the tube and the shaft and selectively depressed such that the elastic member enables the shaft to movably engage with a shape of the undulated edge of the guiding member in a quick and accurate manner, wherein the shaft is movably engaged with one undulated edge with a first undulation pitch distance defined between the two protuberances, and wherein the shaft is movably engaged with another undulated edge with a second undulation pitch distance, with the second undulation pitch distance being different to the first undulation pitch distance, wherein the connecting member includes a first hole extended therethrough, with the tube inserted through the first hole, and wherein the connecting member includes a second hole defined therein and connected with the first hole, with the second hole including a fastening member inserted therethrough and selectively engaged with an outer peripheral of the tube in order to hold the tube in a fixed position.

* * * * *